United States Patent [19]

Wagner et al.

[11] 4,181,032

[45] Jan. 1, 1980

[54] STEERING GEAR

[76] Inventors: William Wagner, 1295 Chartwell Cres., West Vancouver, British Columbia, Canada, V7S 2P9; Daryl A. Wagner, 1094 Hillside Rd., West Vancouver, British Columbia, Canada, V7S 2E9

[21] Appl. No.: 818,366

[22] Filed: Jul. 25, 1977

[51] Int. Cl.[2] ..... F16H 21/44

[52] U.S. Cl. ..... 74/99 R; 74/480 B

[58] Field of Search ..... 74/480 B, 503, 484 R, 74/486, 99 R, 48, 108; 92/68

[56] References Cited

U.S. PATENT DOCUMENTS

| | | | |
|---|---|---|---|
| 868,160 | 10/1907 | Depuy | 114/150 |
| 1,686,263 | 10/1928 | Bristol | 74/108 |
| 2,841,998 | 7/1958 | Troche | 74/99 R |
| 3,044,313 | 7/1962 | Heckathorn | 74/108 |
| 3,448,626 | 6/1969 | Yeatman | 74/108 |
| 3,482,879 | 12/1969 | Droste | 74/108 |
| 4,078,441 | 3/1978 | Mazur | 74/99 R |

FOREIGN PATENT DOCUMENTS

| | | | |
|---|---|---|---|
| 249499 | 4/1927 | United Kingdom | 92/68 |

*Primary Examiner*—Samuel Scott
*Assistant Examiner*—G. Anderson
*Attorney, Agent, or Firm*—Townsend and Townsend

[57] ABSTRACT

An apparatus for rotating a shaft about an axis of rotation less than one full revolution. The apparatus comprises a crank attachable to the shaft; a first link pivotally attached to the crank, the first link having a first attachment point; and a first stop for preventing rotation of the first link about the crank when the shaft is rotated in a first direction from a neutral position. A force applied to the first attachment point has a lever arm to the axis of rotation that lengthens as the shaft is rotated from the neutral position in either clockwise or counter-clockwise direction.

7 Claims, 11 Drawing Figures

Fig. 7.
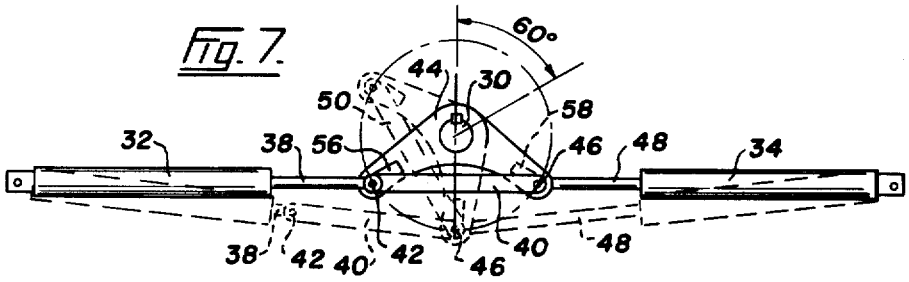
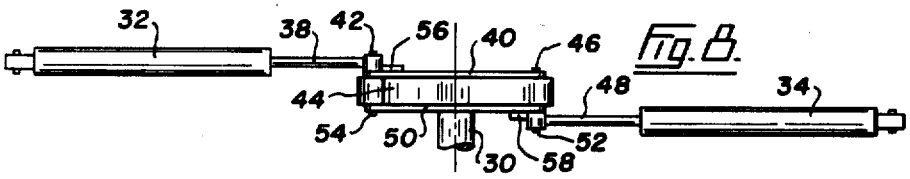
Fig. 8.
Fig. 9.
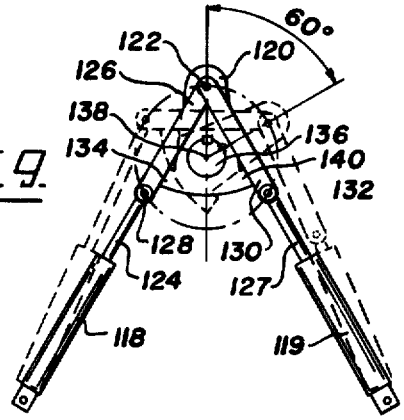
Fig. 10.
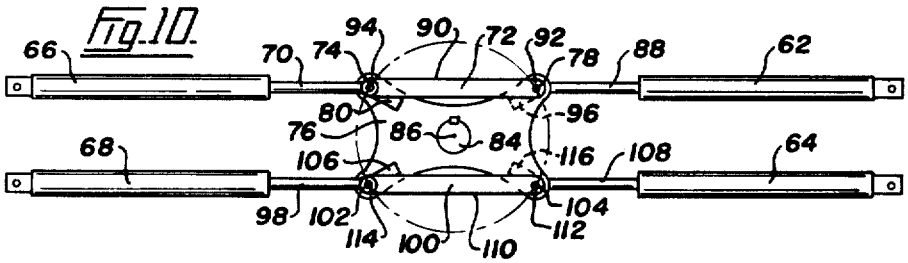
Fig. 11.
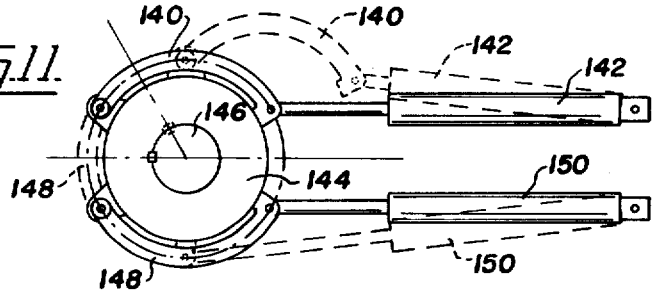

STEERING GEAR

FIELD OF THE INVENTION

This invention relates to an apparatus for rotating a shaft about an axis of rotation less than one full revolution.

DESCRIPTION OF THE PRIOR ART

In one known form, an apparatus for rotating a shaft, such as the rudder shaft for a boat, by means of, for example, two single-acting hydraulic cylinders, consists of a tiller attached to the shaft with two ends 180° apart. Each cylinder is pivotally mounted to one end of the tiller. A disadvantage of this apparatus is that, as the tiller rotates, the distance between the shaft and the lines of action of the cylinders decreases, and consequently the force, which the cylinders must exert to maintain a constant torque on the shaft, increases as the shaft rotates.

A variation of the above device provides that the cylinders are attached to the shaft by means of a chain and sprocket or the like. For example see U.S. Pat. No. 3,448,626 to Yeatman. With this approach, the force exerted by the cylinders to maintain a constant torque on the shaft is independent of the angle or rotation of the shaft. It is well known, however, that in an application such as the rudder shaft of a boat, the torque that must be exerted on the shaft increases as the angle of rotation of the shaft increases in one direction or the other from a neutral position. Returning the rudder of a boat to the neutral position from a hard over position, when the boat is going astern, usually requires even more torque than the torque needed to go from neutral position to a hardover position when the boat is going ahead. With most rudder designs, the torque required at ⅔ reverse engine speed equals the torque required at full engine speed while the boat is going ahead.

SUMMARY OF THE INVENTION

According to this invention, there is provided an apparatus for rotating a shaft about an axis of rotation less than one full revolution. The apparatus comprises crank means attachable to the shaft; a first link pivotally attached to the crank means, the first link having a first attachment point; and first stop means for preventing rotation of the first link about the crank means when the shaft is rotated in a first direction from a neutral position. A force applied to the first attachment point has a lever arm to the axis of rotation that lengthens as the shaft is rotated from the neutral position either in a clockwise or counter-clockwise direction.

Preferably, the apparatus includes a second link pivotally attached to the second crank means, the second link having a second attachment point; and second stop means for preventing rotation of the second link about the second crank point when the shaft is rotated in a second direction from the neutral position. A force applied to the second attachment point has a lever arm to the axis of rotation which lengthens as the shaft is rotated from the neutral position in either a clockwise or a counter-clockwise direction.

The invention gives a torque advantage to linear actuators attached to the attachment points as the shaft rotates in either direction from a neutral position. Since the lever arm of the linear actuators increases as the shaft rotates in either direction from the neutral position, a given force exerted by a linear actuator gives increased torque about the shaft as the shaft rotates from the neutral position. This is particularly advantageous for application on the rudder shaft of a boat since the torque applied to hold the rudder shaft in a given position increases as the rudder moves to one side or the other from the neutral position.

BRIEF DESCRIPTION OF THE DRAWINGS

FIG. 7 is a plan view of an embodiment of the invention wherein two collinear hydraulic cylinders are used;

FIG. 8 is a side elevational view of the embodiment shown in FIG. 7;

FIG. 9 is a plan view of an embodiment of the invention wherein two hydraulic cylinders are connected to a single crank point;

FIG. 10 is a plan view of the embodiment of the invention wherein four hydraulic cylinders are employed;

FIG. 11 is a plan view of a embodiment of the invention wherein the hydraulic cylinders are connected to the crank by curved links.

DESCRIPTION OF THE PREFERRED EMBODIMENT

Figure 1:
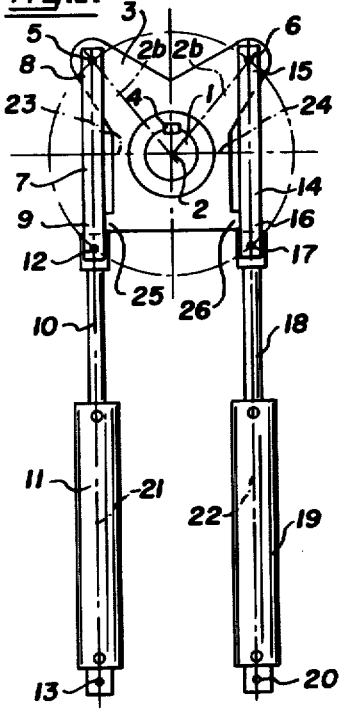
FIG. 1 is a plan view of a first embodiment of the invention, showing the embodiment in a neutral position.
Figure 2:
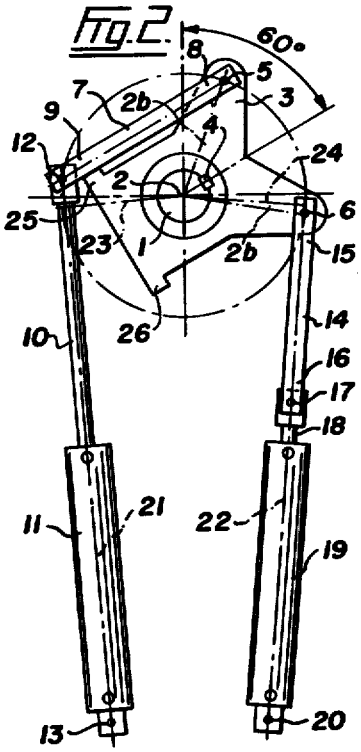
FIG. 2 is a plan view of the first embodiment rotated to its clockwise extreme position of rotation.
Figure 3:
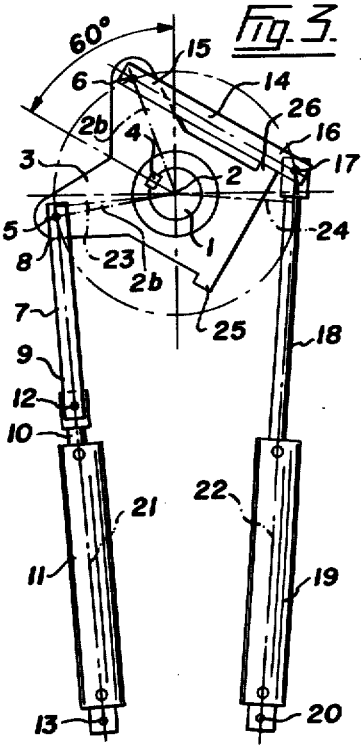
FIG. 3 is a plan view of the first embodiment of the invention rotated counter-clockwise to its extreme position of rotation.
Figure 4:
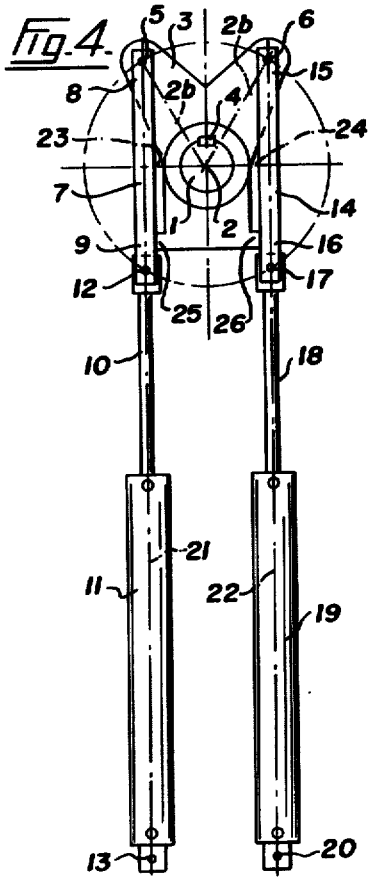
FIG. 4 is a plan view of a second embodiment of the invention shown in the neutral position.
Figure 5:
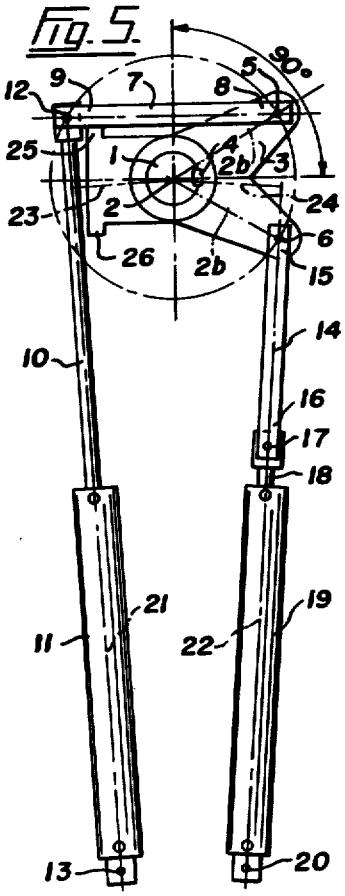
FIG. 5 is a plan view of a second embodiment of the invention shown rotated clockwise to its maximum angle of rotation.
Figure 6:
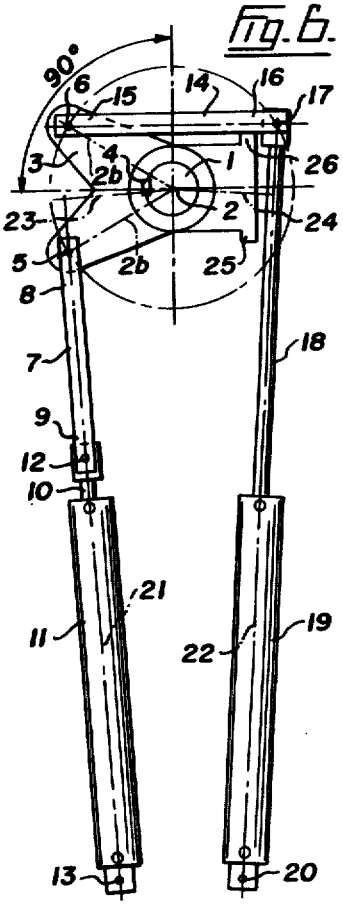
FIG. 6 is a plan view of a second embodiment of the invention rotated counter-clockwise to the maximum angle of rotation.

FIGS. 1, 2, and 3 illustrate a first embodiment of the invention having an angle of 120° of rotation of the shaft 1 between its clockwise and counter-clockwise maximum angles of rotation. FIGS. 4, 5 and 6, wherein like parts are numbered the same as in FIGS. 1, 2 and 3, show a second embodiment of the invention wherein the shaft may rotate 180° between the maximum angles of rotation. The operation of the first and second embodiments as described below, is the same and the rudder is shown aft of the cylinders.

Shaft 1, attached to the rudder of a marine vessel (not shown) is rotatable about an axis of rotation 2 perpendicular to the plane of the drawings. Tiller member or crank 3 is fitted on the shaft and keyed to the shaft by means of key 4. Link pins 5 and 6 are provided on the crank 3 at first and second crank points respectively. Link pins 5 and 6 are angularly spaced with respect to the axis of rotation 2.

A first link 7 has a first end 8 and a second end 9 with shaft 1 located midway between the ends. The first end 8 is pivotally connected to the crank 3 by link pin 5 at a first pivot point a radial distance 2*b* from the axis 2. The second end 9 of the first link 7 is pivotally attached to the rod 10 of hydraulic cylinder 11 by link pin 12 at a first attachment point. The other end of hydraulic cylinder 11 is pivotally connected to the hull of a marine vessel (not shown) by link pin 13.

Second link 14 has a first end 15 and a second end 16 and is spaced-apart from and parallel to link 7 in the position of FIGS. 1 and 4. The first end 15 is pivotally attached to the crank 3 by link pin 6 at a second pivot point. The second end 16 of the second link 14 is pivotally attached to rod 18 of the second hydraulic cylinders 19 by a link pin 17 at a second attachment point. The other end of the hydraulic cylinder 19 is pivotally mounted to the hull of the marine vessel (not shown) by link pin 20.

At each position of the shaft 1, shown in FIGS. 1, 2 and 3 for the first embodiment of the invention, and FIGS. 4, 5, and 6 for the second embodiment of the invention, the first hydraulic cylinder 11 has a line of action 21 and the second hydraulic cylinder 19 has a line of action 22. For each position of the shaft 1, there is a lever arm 23 being the perpendicular distance between the line of action 21 of cylinder 11 and the axis of rotation 2. Further, for each position of shaft 1, there is a lever arm 24 being the perpendicular distance between the line of action 22 of hydraulic cylinder 19 and the axis of rotation 2. As may be seen, as shaft 1 is rotated from the neutral position shown in FIGS. 1 and 4, the lever arms 23 and 24 increase from a length to the maximum length less than radial distance *2b* at approximately the position shown in the remaining Figures. In fact, for the embodiment shows in FIGS. 4 to 6, the lever arm is greatest shortly before the shaft is rotated to extreme position shown in FIGS. 5 and 6. In the embodiments as shown, hydraulic cylinder 19 is used to rotate shaft 1 in a clockwise direction and cylinder 11 is used to rotate shaft 1 in counter-clockwise direction. The torque on shaft 1 is therefore equal to the force exerted by a single cylinder on its power stroke multiplied by the lever arm of that cylinder. Since the lever arm increases as the cylinder rotates shaft 1, the torque on shaft 1 increases for a given force exerted by a cylinder.

The first and second embodiments are both provided with link rotation limiting means comprising stop 25 and stop 26, both of which are integral with crank 3. For the neutral position illustrated in FIGS. 1 and 4 ends 8 and 15 of links 7 and 14 respectively and are to a first side of the shaft 1 with cylinders 11 and 19 to a second side of the shaft, stop 25 contacts the first link 7 and stop 26 contacts link 14. As shown in FIGS. 2 and 5, when the shaft 1 is rotated clockwise from the neutral position, stop 25 contacts the first link 7 and prevents rotation of the first link 7 about the first point 5 in a counter-clockwise direction. As illustrated in FIGS. 3 and 6, when the shaft is rotated in a counter clockwise direction from the neutral position, the second stop 26 contacts the second link 14 and prevents rotation of the second link 14 about the second point 6 in a clockwise direction towards shaft 1. When the shaft 1 is being rotated from a position clockwise of the neutral position, as illustrated in FIGS. 2 and 5, to the neutral position shown in FIGS. 1 and 4, torque is applied to shaft 1 by means of hydraulic cylinder 11. Stop 25 halts the tendency of first link 7 to rotate in a counter-clockwise direction. As rod 10 continues to move into cylinder 11, shaft 1 is rotated in a counter-clockwise direction past the neutral position shown in FIG. 1. Link 7 then has a tendency to rotate in a clockwise direction around link pin 5 and away from stop 25 as shown in FIGS. 3 and 6. As may be seen, stop 26 fulfills a similar function as cylinder 17 rotates shaft 1 in a clockwise direction from the position shown in FIG. 3.

For the first and second embodiments, first end 8 and second end 9 of the first link 7, and first end 15 and second end 16 of second link 14, are equidistant from the axis of rotation 2 when the apparatus is in the neutral position as are link pins 5, 6, 12, and 17. For both embodiments, link pins 5 and 6 on the crank 3 are angularly spaced less than 90° with respect to the axis of rotation 2. With the shaft 1 in the neutral position, as shown in FIGS. 1 and 4, the line of action 21 of the first hydraulic cylinder 11 is substantially parallel to the line of action 22 of the second hydraulic cylinder 19.

In operation, the first embodiment, illustrated in FIGS. 1 to 3, is the same as the second embodiment, illustrated in FIGS. 4 to 6 and, when used for steering a marine vessel, the steering gear operates the same for a turn of the vessel to port as for a turn of the vessel to starboard. Consequently, the operation of the these embodiments will be described only with respect to FIGS. 1 and 2. When the vessel is moving ahead and it is desired to move the vessel to port, the steering gear is turned in the direction shown in FIG. 2. Cylinder 19 is used for this purpose and, as may be seen, the lever arm 24 increases to a maximum length at generally the position shown in FIG. 2. This is important because the maximum torque on the shaft 1 occurs in the hardover position. When it is desired to return the shaft 1 from the hardover position shown in FIG. 2 to the neutral position shown 1, cylinder 11 is employed. As may be seen, the lever arm 23 for cylinder 11 is greater at the hardover position shown in FIG. 2 than in the neutral position shown in FIG. 1. The importance of this feature arises when the vessel is proceeding astern. When proceeding astern, the torque required to return the rudder to the neutral position from hardover is usually even greater than the torque required to move the rudder from neutral to hardover when the vessel is proceeding ahead. The operation of stop 25 in preventing rotation of link 7 about link pin 5 achieves the lengthening of the lever arm 23 when the shaft 1 is rotated in the clockwise direction shown in FIG. 2.

In a third alternative embodiment, the distances between the axis of rotation 2 and link pins 12 and 17 is slightly greater than the distances between the axis of rotation 2 and the link pins 5 and 6. This corrects a small difference between lever arms 23 and 24 when the shaft 1 is in the hardover position.

In fourth alternative embodiments, the hydraulic cylinders 11 and 19 are not parallel in the neutral position but toed in or toed out toward the shaft 1.

FIGS. 7 and 8 illustrate a fifth embodiment of the invention wherein shaft 30 is between collinear hydraulic cylinders 32 and 34. Such a configuration would be useful when fore and aft space is limited and ample space is available athwartship. Rod 38 of cylinder 32 is pivotally attached to link 40 by link pin 42. Link 40 is above crank 44 and is pivotally attached to crank 44 by link pin 46. Rod 48 of cylinder 34 is pivotally attached to link 50 by link pin 52. Link 50 is below crank 44 and is pivotally attached to crank 44 by link pin 54. Stop 56 is welded to the top of crank 44 adjacent link pin 42 and prevents rotation of link 40 in a counter-clockwise direction as shaft 30 rotates in a clockwise direction from the neutral position shown in FIG. 7. Stop 58 is welded to the bottom of crank 44 adjacent link pin 52 and prevents rotation of link 50 in a clockwise direction as shaft 30 is rotated counter-clockwise from the neutral position shown in FIG. 7. The operation of this embodiment of the invention is similar to the embodiments illustrated in FIGS. 1 to 6 and will not be described in detail. The crank 44 is rotatable 60° clockwise 60° from the neutral position shown in solid lines, to the position shown in dotted lines, by cylinder 32 and is rotatable 60° counter-clockwise by cylinder 34.

FIG. 10 illustrates a sixth embodiment of the invention essentially similar to that illustrated in FIGS. 7 and 8 but using four hydraulic cylinders. Here, cylinders 62 and 64 are lower than cylinder 66 and 68. Rod 70 of cylinder 66 is pivotally attached to link 72 by link pin 74. Link 72 is pivotally attached to crank 76 by link pin 78. Stop 80 is welded to the top of crank 76 and prevents rotation of link 72 in a counter-clockwise direction as shaft 84 is rotated about axis of rotation 86 in a clockwise direction. Rod 88 of cylinder 62 is pivotally attached to link 90 (not shown) by link 92 (not shown) generally under link pin 78. Link 90 is pivotally attached to crank 72 by link pin 92 (not shown) approximately under link pin 74. Stop 96 is welded to the bottom of crank 76 adjacent link pin 92 and prevents rotation of link 90 in a clockwise direction as shaft 84 is rotated in the counter-clockwise direction about axis of rotation 86 from the neutral position shown in FIG. 10. Rod 98 of cylinder 68 is pivotally attached to link 100 by link pin 102. Link 100 is pivotally attached to the top of crank 76 by link pin 104. Stop 106 prevents rotation of link 100 in a clockwise direction as shaft 84 rotates about axis of rotation 86 in a counter-clockwise direction from the neutral position shown in FIG. 10. Rod 108 of cylinder 64 is pivotally attached to link 110 (not shown) by link pin 112 (not shown) generally under link pin 104. Link 110 is under crank 76. Link 110 is pivotally attached to crank 76 by link pin 114 (not shown) generally under link pin 102. Stop 116 is welded to the bottom of crank 76 generally adjacent link pin 112. Stop 116 prevents rotation of link 110 in a counter-clockwise direction as shaft 84 is rotated in a clockwise direction from the neutral position shown in FIG. 10. The operation of this embodiment is generally similar to the embodiments illustrated in FIG. 1 to 6 and will not be described in detail.

FIG. 9 shows a seventh embodiment of the invention wherein hydraulic cylinders 118 and 119 are pivotally connected to crank 120 by a single link pin 122 and are located to a side of shaft 136 opposite pin 122. Rod 124 of cylinder 118 is pivotally attached to link 126 by link pin 128. Link 126 is pivotally attached to crank 120 by link pin 122. Rod 127 of cylinder 119, is pivotally attached to link 130 by link pin 132. Link 130 is pivotally attached to crank 120 by link pin 122. Stop 134, welded to the top of crank 120, prevents rotation of link 126 about link pin 122 in a counter-clockwise direction as shaft 136 is rotated in clockwise direction about axis of rotation 138. Stop 140, welded to the top of crank 120, contacts link 130 near link pin 132 in the neutral position shown in FIG. 9 and as shaft 136 is rotated about axis of rotation 138 in a counter-clockwise direction. The operation of this embodiment is similar to the previous embodiment and will not be described in detail. The crank 120 is rotatable 60° clockwise from the neutral position shown in solid lines to the position shown in dotted lines by cylinders 119, and rotatable 60° counter-clockwise by cylinder 118.

FIG. 11 shows an eighth embodiment of the invention wherein curved links 140 and 148 are employed instead of the linear links shown in FIGS. 1 to 6. Such an embodiment is useful if a large hub 144 is attached to the shaft 146 and a short cylinder stroke is desired from cylinders 142 and 150.

The embodiments shown are not exhaustive of the present invention. The invention is particularly suitable where it is desired to rotate a shaft through an angle of from approximately 90° to approximately 220°.

What I claim is:

1. An apparatus for rotating a shaft about an axis of rotation less than one full revolution, the shaft having a neutral position, the apparatus comprising:

a tiller member connectable to the shaft;

two links, each link having a first end and a second end and being pivotally connected to the tiller member near the first end a radial distance from the axis of rotation, the shaft being generally midway between the ends of each link in the neutral position;

link rotation limiting means connected to the tiller member adjacent each link for preventing rotation of the links towards the shaft from a position of the links in the neutral position;

two fluid cylinders, each cylinder having a first end and a second end, means near the first end for pivotally connecting each cylinder to a corresponding said link near the second end of the corresponding link, each cylinder having means near the second end for pivotally mounting said each cylinder, each cylinder having a line of action colinear with the first and second ends of the cylinder, the line of action of each cylinder in the neutral position being colinear with the first and second ends of the corresponding link and being a distance from the axis of rotation less than said radial distance from the axis to the first end of the corresponding link, the distance from the axis to the line of action of each cylinder increasing when the shaft rotates in each direction from the neutral position so the cylinders exert an increasing torque on the shaft.

2. An apparatus as claimed in claim 1, the links being elongate and the shaft being between the links.

3. An apparatus as claimed in claim 2, the links being spaced-apart and generally parallel in the neutral position.

4. An apparatus as claimed in claim 3, wherein in the neutral position, the first ends of the links are to a first side of the shaft and the cylinders are to a second side of the shaft.

5. An apparatus as claimed in claim 1, the links and the cylinders being colinear, a first link being above the tiller member and a second link being below the tiller member, the shaft being between the cylinders.

6. An apparatus as claimed in claim 2, the links being pivotally connected to one point on the tiller member and the cylinders being to a side of the shaft opposite the one point.

7. An apparatus as claimed in claim 1, the link rotating limiting means comprising two stops, each stop being connected to the tiller member adjacent the second end of one said link between the one link and the shaft.

* * * * *